United States Patent [19]

Bottomore et al.

[11] Patent Number: 4,607,566

[45] Date of Patent: Aug. 26, 1986

[54] VENTILATOR FOR USE IN A ROOF STRUCTURE

[75] Inventors: David Bottomore, Huddersfield; Colin F. Gibson, Long Eaton, both of United Kingdom

[73] Assignee: Glidevale Building & Products Limited, Pinxton, United Kingdom

[21] Appl. No.: 690,663

[22] Filed: Jan. 10, 1985

[30] Foreign Application Priority Data

Jan. 12, 1984 [GB] United Kingdom ..... 8400758
Aug. 25, 1984 [GB] United Kingdom ..... 8421657

[51] Int. Cl.[4] ..... E04B 7/18

[52] U.S. Cl. ..... 98/37; 98/DIG. 6; 52/95; 52/199; 52/303; 52/305

[58] Field of Search ..... 52/95, 198, 199, 303, 52/302, 305; 98/DIG. 6, 37

[56] References Cited

U.S. PATENT DOCUMENTS 345,688 7/1886 Hayes ..... 52/199
2,954,727 10/1960 Katt et al. ..... 52/199
3,160,987 12/1964 Pinkley ..... 52/95
3,240,144 3/1966 Lind ..... 98/DIG. 6
3,777,649 12/1973 Luckey ..... 52/95

FOREIGN PATENT DOCUMENTS 2070117 9/1981 United Kingdom ..... 52/302
2089968A 6/1982 United Kingdom .
2096667A 10/1982 United Kingdom .

*Primary Examiner*—William F. Pate, III
*Assistant Examiner*—Caroline Dennison
*Attorney, Agent, or Firm*—Poms, Smith, Lande & Rose

[57] ABSTRACT

A ventilator for use in a roof structure of the type having a fascia and cover material at least partially overlying the fascia comprises a panel member adapted to engage the cover material, and means to define first and second communicating ventilation paths. The first ventilation path extends between the panel member and an outer face of the fascia, and the second ventilation path extends between the cover material and the fascia.

15 Claims, 8 Drawing Figures

VENTILATOR FOR USE IN A ROOF STRUCTURE

BACKGROUND OF THE INVENTION

This invention relates to a ventilator for use in a roof structure.

It is common in buildings for the roof structure in the region of the eaves to be provided with a fascia and a soffite board which is connected to an external wall and which extends substantially transverse to the fascia. Roof covering material usually overlies the upper edge of the fascia. An air gap is often provided between the fascia and the soffite board to provide a ventilation path to the roof space within the roof structure. This ventilation path is desirable because it helps to prevent problems of condensation which would otherwise occur due to the high efficiency of modern loft insulation.

However, in some roof structures there is no air gap between the fascia and the soffite board. And in other roof structures the soffite board may be dispensed with entirely, the fascia being attached to the top of the external brickwork. An example of this latter type of roof structure is shown in our United Kingdom Pat. No. 2096667B.

In these roof structures the ventilation can be provided over the top of the fascia board between the upper edge of the fascia board and the roof covering material.

It is also common for buildings to include a main building and an extension building which is adjacent the main building. The extension building may be built at the same time as the main building or may be added on subsequently.

The roof structure of the extension building is often separate from the roof structure of the main building, and is usually disposed lower than the roof structure of the main building adjacent a wall thereof.

In order to provide adequate ventilation to the roof space of the extension building it is desirable to provide a ventilation path to the roof space.

SUMMARY OF THE INVENTION

It is an object of the present invention to provide an improved ventilator which can provide ventilation to either of the aforementioned roof structures.

According to one aspect of the invention there is provided a ventilator for use in a roof structure of the type having a fascia and cover material at least partially overlying the fascia, said ventilator comprising a panel member, and spacing means adapted to space the panel member from a face of the fascia to define a first ventilation path between the fascia and the panel member, the spacing means being also adapted to extend over an upper edge of the fascia to define a second ventilation path between the cover material and the fascia, said first ventilation path communicating with said second ventilation path.

The fascia may be any elongate board or panel provided in a roof structure.

Advantageously the spacing means comprises a plurality of spacing members provided on the panel member.

Preferably the spacing members are adapted to extend over an upper edge of the fascia to define the second ventilation path between adjacent spacer members.

Conveniently each spacer member includes a first portion adapted to extend along the outer face of the fascia board, and a second portion adapted to extend along the upper edge of the fascia board; the first and second portions may be integral.

Desirably baffle means is provided to divide the first ventilation path into a plurality of air flow paths.

Advantageously the baffle means comprises a plurality of baffle members which are arranged across the ventilation path at substantially equi-spaced intervals. The baffle members may be disposed so that they extend substantially parallel to the panel member.

Desirably each baffle member is secured to the spacer members.

Securing means can be provided for securing the ventilator to the roof structure. The securing means preferably comprises two elongate members which are spaced to form a slot therebetween. A screw or nail having a head of greater diameter than the width of the slot may be inserted through the slot, and screwed or hammered into the upper edge of the fascia until the head of the screw or nail abuts against the elongate members.

According to another aspect of the invention there is provided a ventilated roof assembly comprising a fascia, cover material at least partially overlying the fascia, and a ventilator; said ventilator including a panel member, and spacing means being also adapted to extend over an upper edge of the fascia to define a second ventilation path between the cover material and the fascia, said first ventilation path communicating with said second ventilation path.

Preferably the means to define the first and second ventilation paths comprises a plurality of spacing members as described above.

Preferably also, baffle means, as described above, is provided to divide the first ventilation path into a plurality of air flow paths.

In one embodiment the fascia is part of the roof structure of an extension building adjacent a main building.

In this embodiment the fascia may be spaced from an outer wall of the main building in order to define a ventilation path, between the fascia and the outer wall, to a roof space of the extension building.

The ventilator of the present invention has many advantages over earlier ventilators. In particular, the ventilator can be used in a wide variety of different roof structures.

The ventilator can easily be installed in roof structures after the construction thereof, without the need for replacing any of the existing structure.

BRIEF DESCRIPTION OF THE DRAWINGS

Reference is now made to the accompanying drawings, in which.

DETAILED DESCRIPTION OF THE INVENTION

Figure 1:
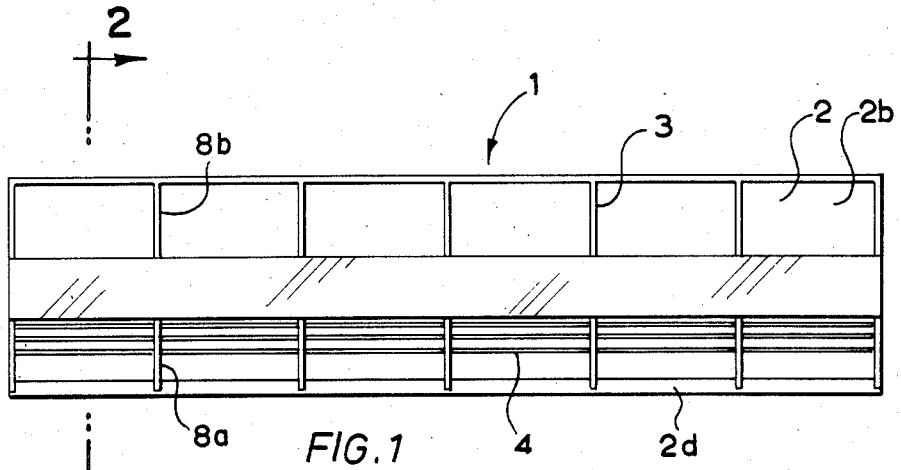
FIG. 1 is an elevation of a ventilator according to the invention.
Figure 2:
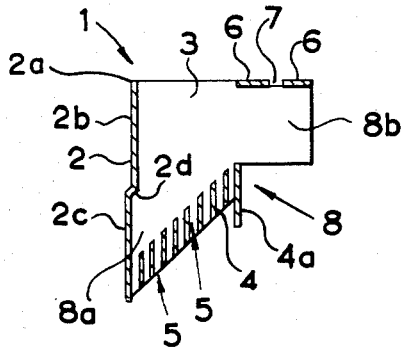
FIG. 2 is a section along lines 2—2 of FIG. 1.

In FIGS. 1 to 8 a ventilator generally designated 1 comprises a panel member 2 to which means to define first and second ventilation paths in the form of a plurality of spacing members 3 are secured. The spacing members 3 extend substantially transversely to the panel member 2.

The panel member 2 comprises two non-coplanar portions 2*b* and 2*c* which lie in parallel planes. The portions 2*b* and 2*c* are connected by a connecting portion 2*d*.

Baffle means in the form of a plurality of baffle members 4 are secured to the spacer members 3 and extend substantially parallel to the panel member 2. The baffle members 4 define a plurality of air flow channels 5.

Securing means comprising two elongate members 6 is attached to the spacer members 3 and a slot 7 is defined between the elongate members 6.

The spacing members 3 each include a first portion 8*a* which can extend along an outer face of a fascia and a second portion 8*b* which can extend along an upper edge of the fascia. The baffle member furthest from the panel member 2 (designated 4*a* in the drawings) is disposed so that it can engage the outer face 9*b* of the fascia 9.

Figure 3:
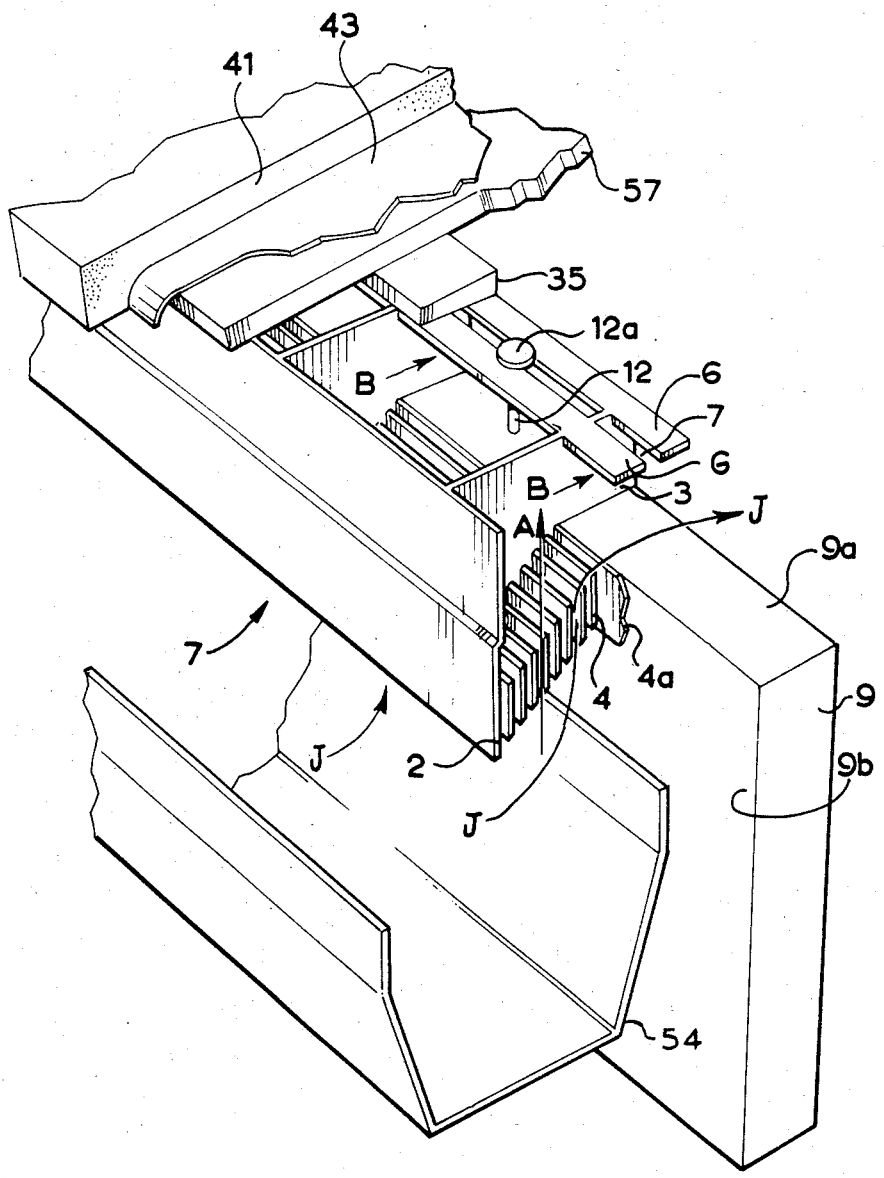
FIG. 3 is a perspective view of a pitched roof structure incorporating the ventilator shown in FIGS. 1 and 2.
Figure 4:
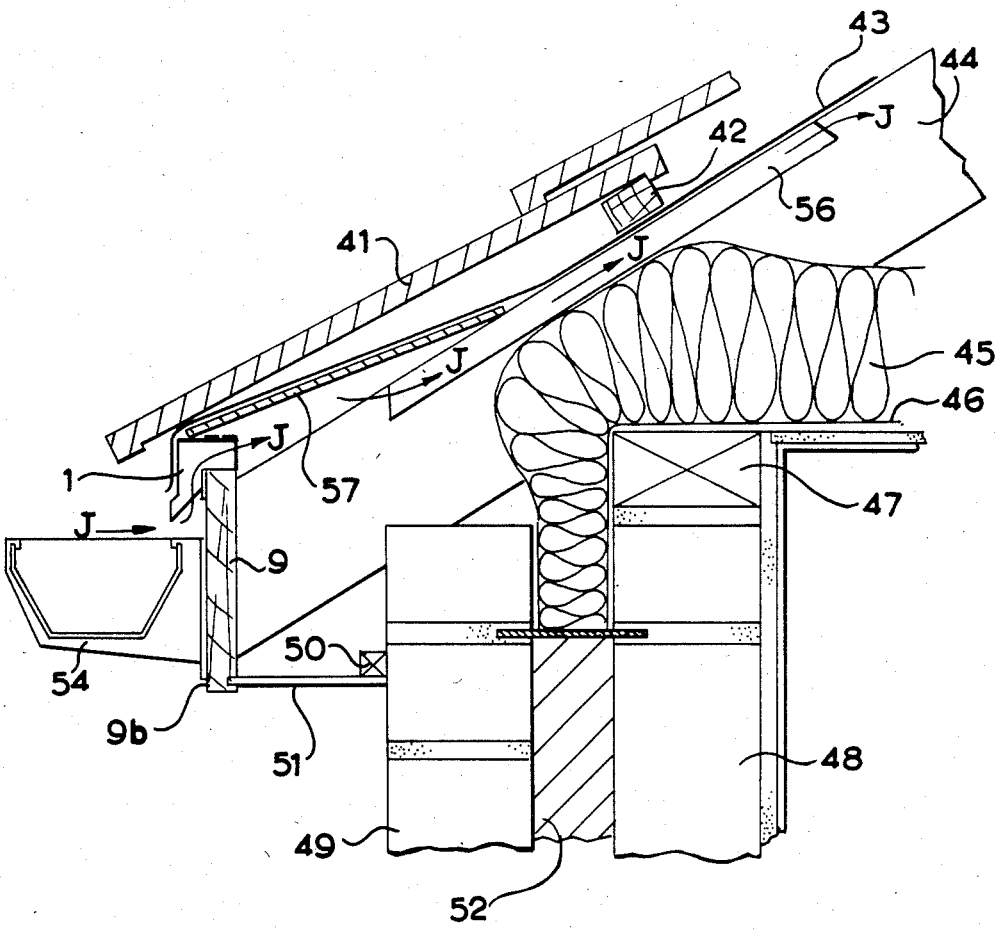
FIG. 4 is a cross-sectional view of the roof structure shown in FIG. 3.

FIGS. 3 and 4 show the ventilator 1 in a pitched roof structure and adjacent a fascia board 9. The second portion 8*b* of the spacing members engages a upper edge 9*a* of the fascia 9 and baffle member 4*a* engages an outer face 9*b* of the fascia.

The roof structure includes cover material in the form of roof tiles 41 arranged upon battens 42 which are in turn arranged upon sarking felt 43. The sarking felt 43 is nailed to roof joists 44.

A layer of insulating material 45 is arranged over a floor 46 of the roof structure and extends over a wall plate 47 located at the top of an inner leaf 48 of a cavity wall structure. The cavity wall structure also includes an outer leaf 49, to which a batten 50 is attached; a soffite board 51 is attached to the batten 50. Cavity wall insulating foam 52 is located between the two leaves 48 and 49 of the cavity wall structure. The leaves 48 and 49 may, for example, comprise bricks.

The fascia 9 is attached to one end of the joists 44 and the soffite board 51; as shown in FIGS. 3 and 4 there is no air gap between the soffite board 51 and the fascia.

An external gutter 54 is located forward of the fascia board 9. A roof space ventilator 56 is arranged between the sarking felt 43 and the insulating material 45, in order to provide an air passageway therebetween; the roof space ventilator serves to space the sarking felt 43 from the insulating material. A roof space ventilator suitable for this purpose is described in our United Kingdom Pat. No. 2,089,968. A roofing board 57, which also forms part of the cover material, is provided beneath the sarking felt 43 and lies on the fascia ventilator 1 and the joists 44 in order to prevent the sarking felt sagging between the joists in the region adjacent the fascia ventilator.

The first portion 8*a* of the spacing members 3 spaces the panel member 2 from the outer face 9*b* of the fascia 9 in order to define a first ventilation path A between the panel member and the outer face. A second ventilation path B is defined between the upper edge 9*a* of the fascia 9 and the cover material 41, 43, 57 of the roof by the second portion 8*b* of the spacer members 3. The first ventilation path A communicates with the second ventilation path B and extends in a direction which is substantially transverse thereto.

The roofing board 57 engages the upper edge 2*a* of the panel member in order to restrict air flow between the board 57 and the panel member 2. This ensures that the only air flow path into the roof space over the fascia 9 is through the ventilation paths A and B.

A nail 12 extends through the slot 7 into the upper edge 9*a* of the fascia board 9 in order to secure the ventilator 1 to the roof structure. A head 12*a* of the nail 12 is of a greater diameter than the width of the slot 7 so that the head abuts against the elongate members 6.

A wedge 35 is disposed between the elongate members 6 and the roofing board 57, and engages both the elongate members 6 and the roofing board 57.

The arrows A and B show the air flow path through the first and second ventilation paths. The air flow from the external environment to the roof space is shown by arrows J.

Figure 5:
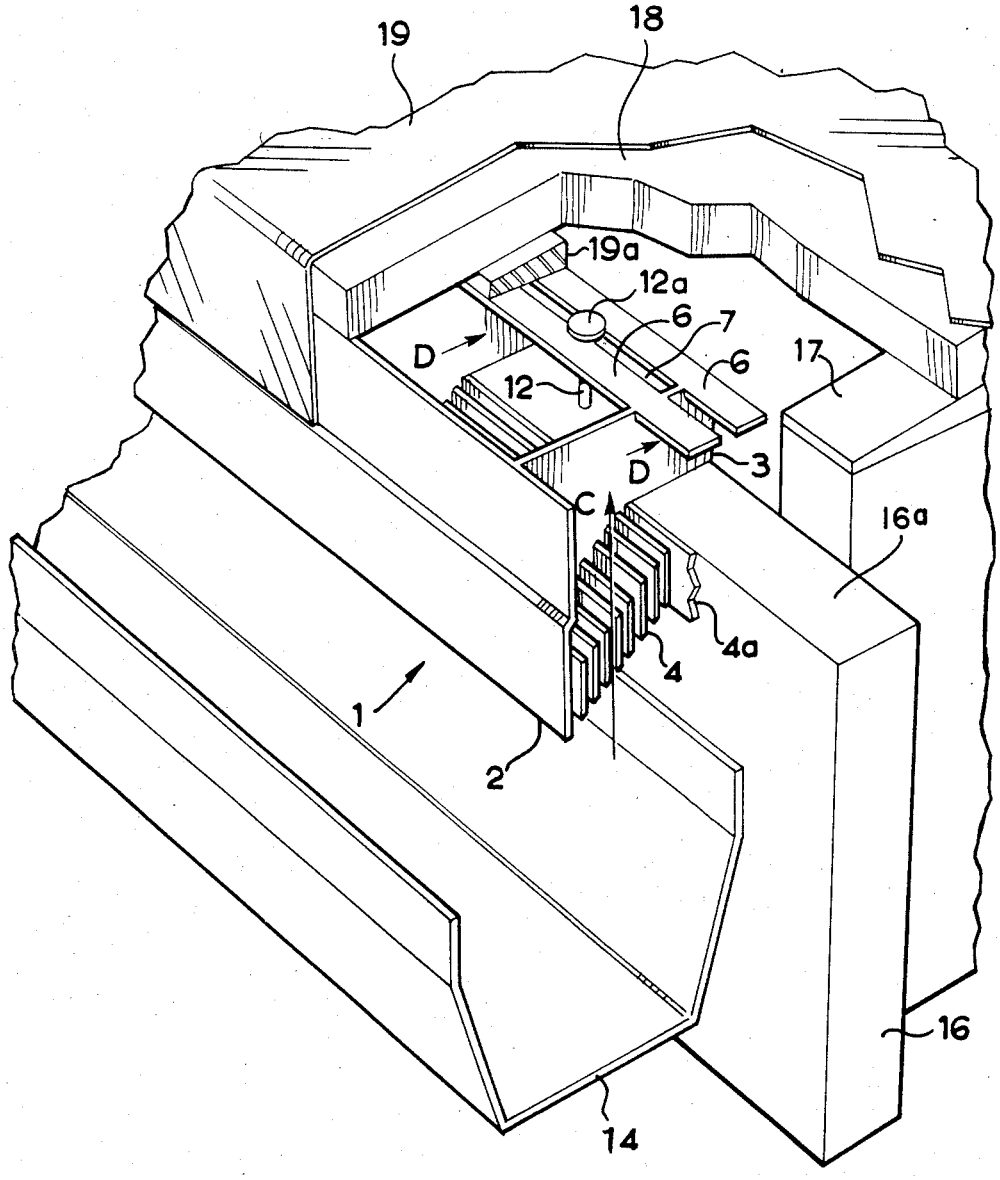
FIG. 5 is a perspective view of one form of flat roof structure incorporating the ventilator shown in FIGS. 1 and 2.

In FIG. 5, the ventilator 1 is shown located above a gutter 14, at the lower edge of a flat roof structure.

The ventilator 1 is attached to a fascia 16 in the same way as the ventilator is attached to the fascia 9 in FIG. 3. The fascia 16 runs transverse to, and is secured to, rafters 17.

The first portion 8*a* of the spacer members 3 spaces the panel member 2 from the outer face 16*b* of the fascia 16 in order to define a first ventilation path C between the panel member and the outer face. A second ventilation path D is defined between the upper edge 16*a* of the fascia 16 and cover material 18, 19 by the second portion 8*b* of the spacer members 3. The first ventilation path C communicates with the second ventilation path D and extends in a direction which is substantially transverse thereto.

The cover material comprises a roofing board 18 and roof felt 19 overlying the fascia 16. If desired, the roof felt may be replaced with, for example, a sheet of copper or lead.

The roofing board 18 extends over the ventilator 1 and engages the upper edge 2*a* of the panel member 2, in order to restrict air flow between the board 18 and the panel member 2. This ensures that the only air flow path into the roof space over the fascia 16 is through the ventilating paths C and D. A wedge 19*a* is disposed between the roofing board 18 and the elongate members 6.

The roof felt 19 engages the surface of the portion 2*b* of the ventilator 1. The roof felt 19 is arranged so that its outer surface is flush with the outer surface of the portion 2*c* of the panel member 2.

An air flow path through the ventilator is shown by arrows C and D.

Figure 6:
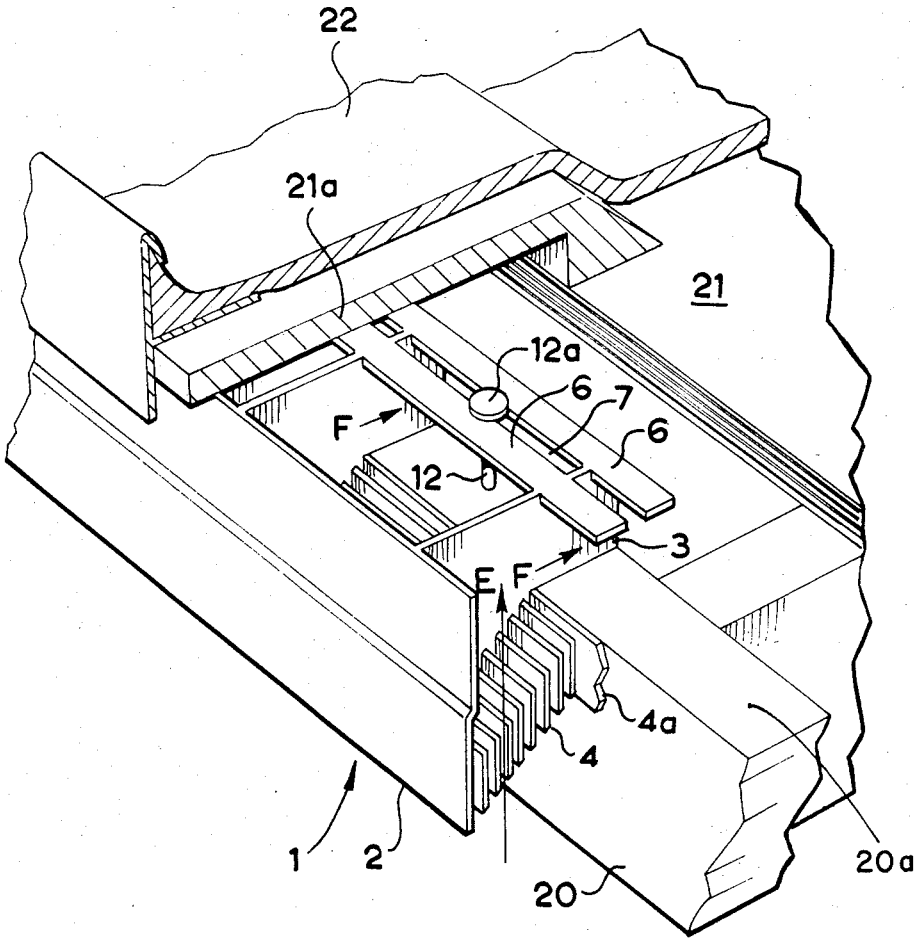
FIG. 6 is a perspective view of another form of flat roof structure incorporating the ventilator shown in FIGS. 1 and 2.

In FIG. 6 the ventilator 1 is shown disposed at the high edge of a flat roof structure.

The ventilator 1 is attached to a fascia 20 in the same way as the ventilator 1 is attached to the fascia 9 in FIG. 3.

The first portion 8*a* of the spacer members 3 spaces the panel member 2 from the outer face 20*b* of the fascia 20 in order to define a first ventilation path E between the panel member and the outer face. A second ventilation path F is defined between the upper edge 20*a* of the fascia 20 and cover material 21, 22 by the second portion 8*b* of the spacer members 3. The first ventilation path E communicates with the second ventilation path F and extends in a direction which is substantially transverse thereto.

The cover material comprises a roofing board upstand 21*a* secured to a roofing board 21 over which lies an asphalt layer 22. If desired, the asphalt layer may be replaced with, for example, a layer of built-up felt, or other roof covering material.

The roofing board upstand 21*a* extends over the ventilator 1 and engages the upper edge 2*a* of the panel member 2 to restrict air flow between the roofing board upstand and the panel member and ensure that the only air flow path over the fascia 20 is through the ventilation paths E and F.

An air flow path through the ventilator is shown by arrows E and F.

Figure 7:
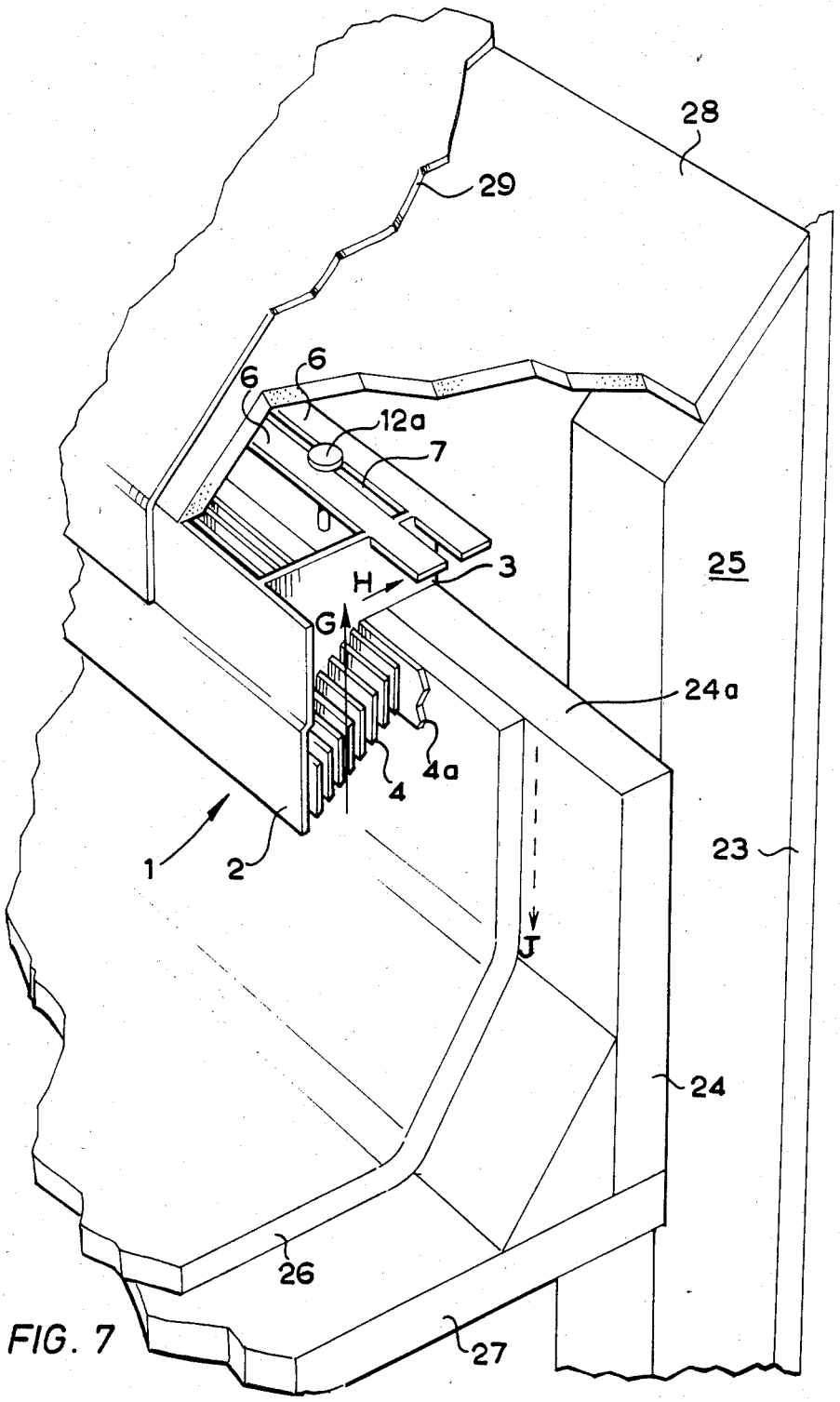
FIG. 7 is a perspective view showing the ventilator illustrated in FIGS. 1 and 2 being used to provide ventilation over a fascia of an extension building.
Figure 8:
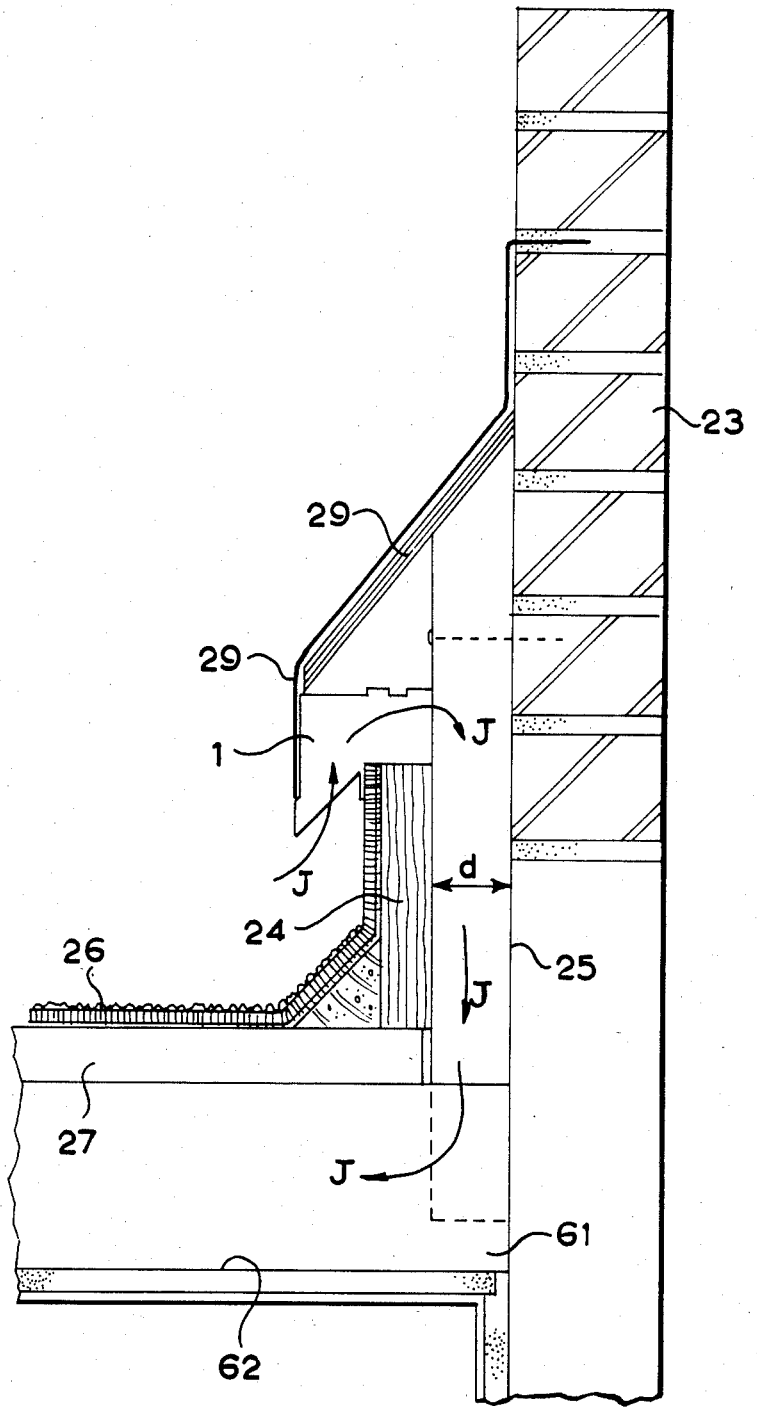
FIG. 8 is a cross-sectional view of the roof structure shown in FIG. 7.

FIGS. 7 and 8 show the ventilator 1 when used to provide ventilation to the roof space of an extension building adjacent a main building, i.e. at the abutment with a wall in mono pitch construction.

In FIGS. 7 and 8 the roof structure of the extension building is of the "flat roof" type. It will be appreciated that the ventilator 1 may also be used to provide ventilation to the roof spaces of extension buildings having the "pitched roof" type of structure.

An air gap "d" between a main building and an extension building is defined between an outer wall 23 of the main building and a fascia 24 which is secured to, and supported by, a roof deck 27 of the extension building. The fascia 24 is secured to battens 25 which serve to space the fascia from the wall 23.

The battens 25 are secured to joist 61 extending transversely thereto; the joists are secured to the outer wall 23. A floor 62 of the roof structure extends beneath the joists, and a roof space is defined between adjacent joists 61 and between the floor 62 and the roof deck 27.

The ventilator 1 is secured to the fascia 24 in the same way as the ventilator 1 is attached to the fascia 9 in FIG. 3.

The first portion 8*a* of the spacer members 3 spaces the panel member 2 from the outer face 24*b* of the fascia 24 in order to define a first ventilation path G between the panel member and the outer face. A second ventilation path H is defined between the upper edge 24*a* of the fascia 24 and cover material 28, 29 by the second portion 8*b* of the spacer members 3. The first ventilation path G communicates with the second ventilation path H and extends in a direction which is substantially transverse thereto.

The cover material comprises a roofing board 28 over which lies lead flashing 29.

The roof structure of the extension building is provided with extension building roof cover material 26 which may comprise asphalt or built up felt. This cover material 26 extends over the roof deck 27 and between the baffle member 4*a* and the fascia 24.

The roofing board 28 extends from, and is secured to, the battens 25 and engages the upper surface 2*a* of the panel member 2, to restrict the air flow between the roofing board 28 and the panel member 2, in order to ensure that the only air flow path into the roof space over the fascia 24 is through the ventilation paths G and H. A wedge (not shown) can be provided between the roofing board 28 and the elongate members 6.

The lead flashing 29 is arranged over the roofing board 28 and engages the surface of the portion 2*b* of the ventilator 1. The lead flashing is arranged so that its outer surface is flush with the outer surface of the portion 2*c* of the panel member 2.

An air flow path through the ventilator 1 is shown by arrows G and H. The air flow from the external environment to the roof space is shown by arrows K.

The cross-sectional area available for air flow between the panel member 2 and the fascia boards 9, 16, 20 or 24 of the roof structure is dependent upon the size and frequency of the baffle members 4.

This can be chosen so that the ventilator provides sufficient area for air flow specified to meet the building regulations required by the laws of any country, such as, for example, U.K. in the Public Health Act. The baffles also help to prevent ingress of vermin and large insects into the roof structure.

We claim:

1. A ventilator for use in a roof structure of the type having a fascia and cover material at least partially overlying the fascia, said ventilator comprising a panel member, spacing means engageable with a face of the fascia for spacing the panel member from the face of the fascia to define a first ventilation path between the fascia and the panel member, the spacing means being engageable with an upper edge of the fascia to define a second ventilation path between the cover material and the fascia, and said first ventilation path communicating with said second ventilation path.

2. A ventilator according to claim 1 in which the spacing means comprises a plurality of spacing members provided on the panel member.

3. A ventilator according to claim 2 in which the spacing members are engageable with the upper edge of the fascia to define the second ventilation path between adjacent spacing members.

4. A ventilator according to claim 1 in which baffle means is provided to divide the first ventilation path into a plurality of air flow paths.

5. A ventilator according to claim 4 in which the baffle means comprises a plurality of baffle members each spaced from the panel member by a different distance.

6. A ventilator according to claim 5, in which each baffle member is secured to the spacer members.

7. A ventilated roof assembly comprising a fascia, cover material at least partially overlying the fascia, and a ventilator, said ventilator further comprising a panel member, spacing means which engages a face of the fascia for spacing the panel member from the face of the fascia to define a first ventilation path between the fascia and the panel member, the spacing means engageable with an upper edge of the fascia to define a second ventilation path between the cover material and the fascia, and said first ventilation path communicating with said second ventilation path.

8. An assembly according to claim 7 in which the spacing means comprises a plurality of spacing members provided on the panel member.

9. An assembly according to claim 8 in which the spacing members extend over the upper edge of the fascia to define the second ventilation path between adjacent spacing members.

10. An assembly according to claim 7 in which baffle means is provided to divide the first ventilation path into a plurality of air flow paths.

11. An assembly according to claim 7 in which the fascia is part of the roof structure of an extension building adjacent a main building.

12. An assembly according to claim 11 in which the main building comprises an outer wall, and said fascia is in a spaced relationship from said outer wall, thereby defining a ventilation path between the fascia and the outer wall which communicates with the roof space of the extension building.

13. An assembly according to claim 12 in which the ventilation path between the fascia and the outer wall also communicates with the second ventilation path.

14. A ventilator for use in a roof structure of the type having a fascia and cover material at least partially overlying the fascia, said ventilator comprising a panel member, spacing means engageable with a face of the fascia for spacing the panel member from the face of the fascia to define a first ventilation path between the fascia and the panel member, the spacing means being engageable with an upper edge of the fascia to define a second ventilation path between the cover material and the fascia, said first ventilation path communicating with said second ventilation path, and said spacing means further comprises a plurality of spacing members provided on the panel member wherein each spacing member includes a first portion engageable with the face of the fascia and a second portion engageable with the upper edge of the fascia.

15. A ventilator for use in a roof structure of the type having a fascia and cover material at least partially overlying the fascia, said ventilator comprising a panel member, spacing means engageable with a face of the fascia for spacing the panel member from the face of the fascia to define a first ventilation path between the fascia and the panel member, the spacing means being engageable with an upper edge of the fascia to define a second ventilation path between the cover material and the fascia, said first ventilation path communicating with said second ventilation path, and securing means for securing the ventilator to the upper edge of the fascia.

* * * * *